US006648330B2

(12) United States Patent
Porter

(10) Patent No.: US 6,648,330 B2
(45) Date of Patent: Nov. 18, 2003

(54) THREE DIMENSIONAL PUZZLE

(76) Inventor: Michael Porter, 360 A Bloor St. W #19002, Toronto, Ont. (CA), M5S 1X1

( * ) Notice: Subject to any disclaimer, the term of this patent is extended or adjusted under 35 U.S.C. 154(b) by 0 days.

(21) Appl. No.: 10/071,093

(22) Filed: Feb. 11, 2002

(65) Prior Publication Data

US 2003/0151195 A1 Aug. 14, 2003

(51) Int. Cl.[7] ..... A63F 9/12
(52) U.S. Cl. ..... 273/153 R; 273/156
(58) Field of Search ..... 273/153 R, 156, 273/157; 434/403, 406, 433

(56) References Cited

U.S. PATENT DOCUMENTS

| | | | | | |
|---|---|---|---|---|---|
| 332,256 | A | * | 12/1885 | Keeler | 273/160 |
| 3,788,645 | A | * | 1/1974 | Nelson | 273/156 |
| 4,153,254 | A | | 5/1979 | Mare | |
| 4,534,563 | A | * | 8/1985 | Guenther | 273/157 R |
| 4,662,638 | A | | 5/1987 | Vachek | |
| 4,699,602 | A | | 10/1987 | Giorgi | |
| 4,784,392 | A | | 11/1988 | Johnson et al. | |
| 4,844,466 | A | * | 7/1989 | Johnson et al. | 273/157 R |
| 5,393,063 | A | | 2/1995 | Iohimaru | |
| 5,405,135 | A | | 4/1995 | Embro | |
| 5,868,388 | A | * | 2/1999 | Wood et al. | 273/157 R |
| 6,095,521 | A | | 8/2000 | Patel | |

* cited by examiner

*Primary Examiner*—Kien T. Nguyen

(57) ABSTRACT

The present invention provides for a new three dimensional puzzle apparatus having fifteen geometrically different components which can be interconnected to form a four by four by four cube. The four by four by four cube is subdivided into sixty four equally sized smaller cubes. Each of the fifteen individual pieces have from one to six of such smaller cubes interconnected to one another to form a unique three dimensional shape. The fifteen pieces include one piece with one small cube, one piece with three small cubes, six pieces with four small cubes, six pieces with five small cubes and one piece with six small cubes. The three dimensional puzzle can be used as a toy or game as well as for educational and security purposes.

4 Claims, 3 Drawing Sheets

THREE DIMENSIONAL PUZZLE

FIELD OF THE INVENTION

The present invention is directed to a three dimensional puzzle which can be utilized as a toy or a game as well as for educational or security purposes.

BACKGROUND OF THE INVENTION

The use of various three dimensional puzzles constructed of a plurality of pieces of different shapes which fit together to form a polyhedric structure is well known. Examples of such puzzles are shown in amongst other U.S. Pat. Nos. 4,153,254, 4,662,638, 5,405,135, 6,095,521, 4,699,602, 5,393,063 and 4,784,392.

SUMMARY OF THE INVENTION

The present invention provides for a new three dimensional puzzle apparatus and method which in one aspect comprises fifteen geometrically different components which can be interconnected to form a four by four by four cube. The four by four by four cube may be subdivided into sixty four equally sized smaller cubes. Each of the fifteen individual pieces comprises from one to six of such smaller cubes interconnected to one another to form a unique three dimensional shape. The fifteen pieces have one piece with one small cube, one piece with three small cubes, six pieces with four small cubes, six pieces with five small cubes and one piece with six small cubes.

In an aspect of the invention, the three dimensional puzzle is constructed of a plurality of small wooden cubes joined to one another to form the individual pieces.

In yet another aspect of the invention, the three dimensional puzzle is provided as an electronic game.

BRIEF DESCRIPTION OF THE DRAWINGS

Preferred embodiments of the present invention are shown in the drawings, wherein.

DETAILED DESCRIPTION OF THE PREFERRED EMBODIMENTS

Figure 1A:
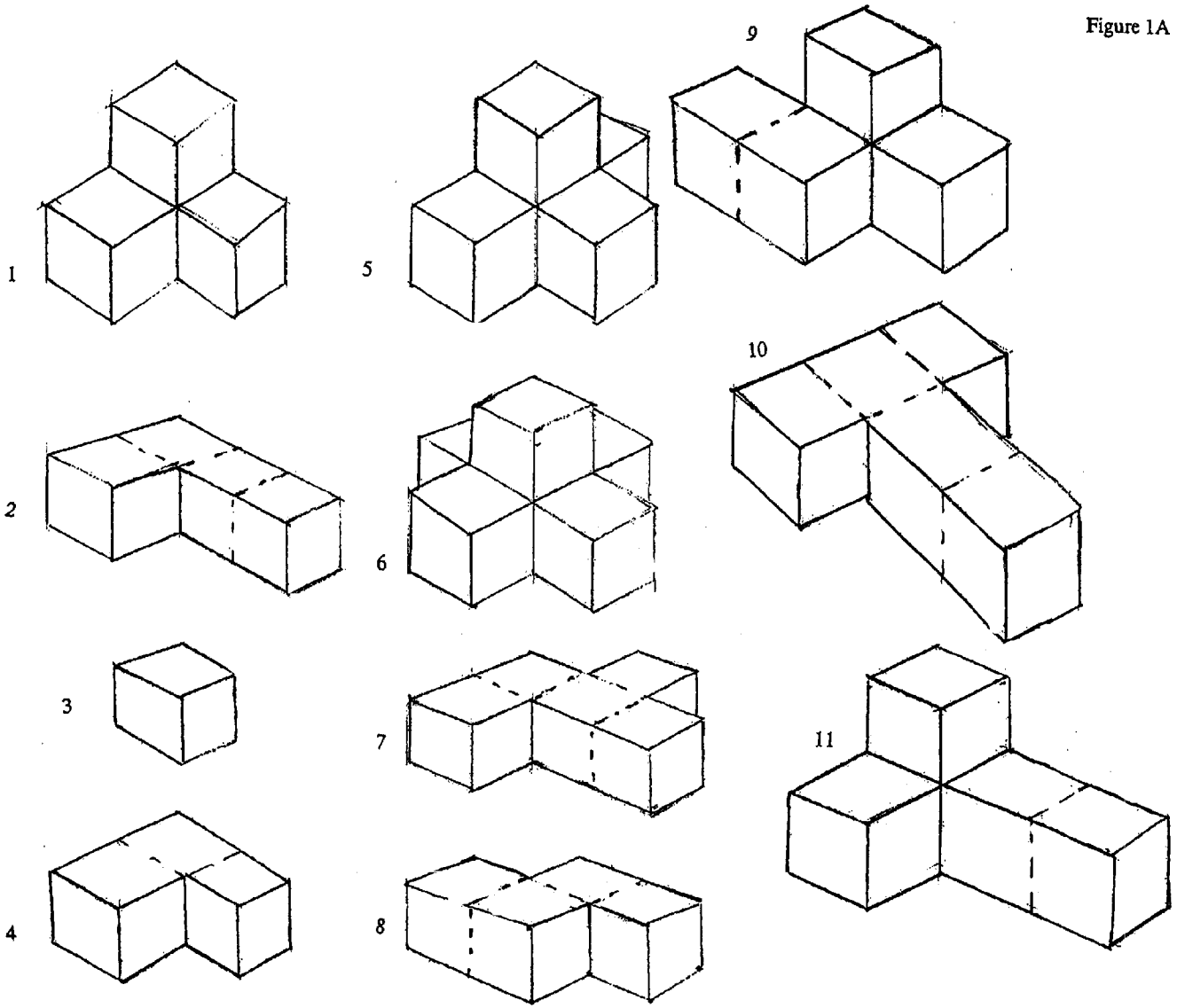
FIG. 1 is a schematic view of the fifteen individual pieces of the puzzle of the present invention.

The present inventions provides for a three dimensional puzzle having fifteen geometrically different components which interconnect to form a four by four by four cube. This four by four by four cube is subdivided into sixty four equally sized smaller cubes. The individual components 1 to 15 of the puzzle cube of the present invention are illustrated in perspective in FIG. 1. The shaping of the individual pieces will be described in relation to the way the individual small cubes are joined to one another to form the configuration of the individual piece.

Piece number 1 has four individual small cubes with a first base cube having two other cubes joined to adjacent sides and a fourth cube joined to a top surface.

Piece 2 has four individual small cubes with three cubes connected in series and a fourth cube connected to the adjacent side of the first cube in the three cube series.

Piece 3 is a single individual small cube.

Piece 4 is a three cube configuration with two small cubes adjoined to adjacent sides of a third base cube.

Piece 5 is a five cube piece having a base cube with three cubes joined to adjacent sides, and the fifth cube being joined to the top surface of the base cube.

Piece 6 is a six cube piece having four cubes joined to each of the sides of the base cube and the sixth cube being joined to the top surface of the base cube.

Piece 7 is a five cube piece having three cubes joined to one another in series with a fourth cube joined to the side of the base cube and the fifth cube joined to the side of the middle cube in the series opposite the side in which the fourth cube lays.

Piece 8 is a four cube configuration having two cubes joined side by side with a third cube extending forwardly from the side of the right hand of the joined cubes and the fourth cube extending rearwardly from the left hand at the joined cubes and in the same plane as the two joined cubes.

Piece 9 is a five piece cube having a four cube configuration similar to piece 8 with a fifth cube attached to the top surface of the right hand of the two joined cubes.

Piece 10 is a five cube configuration in the shape of a tee being three cubes across the top and two cubes joined to the side of the middle cube in the top.

Piece 11 is a five cube piece having a base cube with an individual cube joined to one side surface and two cubes in series joined to a second adjacent side surface.

The fifth cube is joined to the top surface of the base cube.

Piece 12 is a four cube configuration in the shape of a tee having three cubes joined in series and the fourth cube joined at the side of the middle cube in the series.

Piece 13 is a five cube configuration having a base of three cubes in series with a fourth cube joined to the left side of the end most of the cubes in the series, and the fifth cube joined to top the surface of the middle cube in the series.

Pieces 14 and 15 are both four cube configurations having two sets of two cubes joined in series with a two cube set interconnected perpendicular to one another at side surfaces of end cubes. The configuration of pieces 14 and 15 are mirror images of one another in that the side to which the perpendicular cubes are joined in piece 15 is opposite to that of piece 14.

Figure 1B:
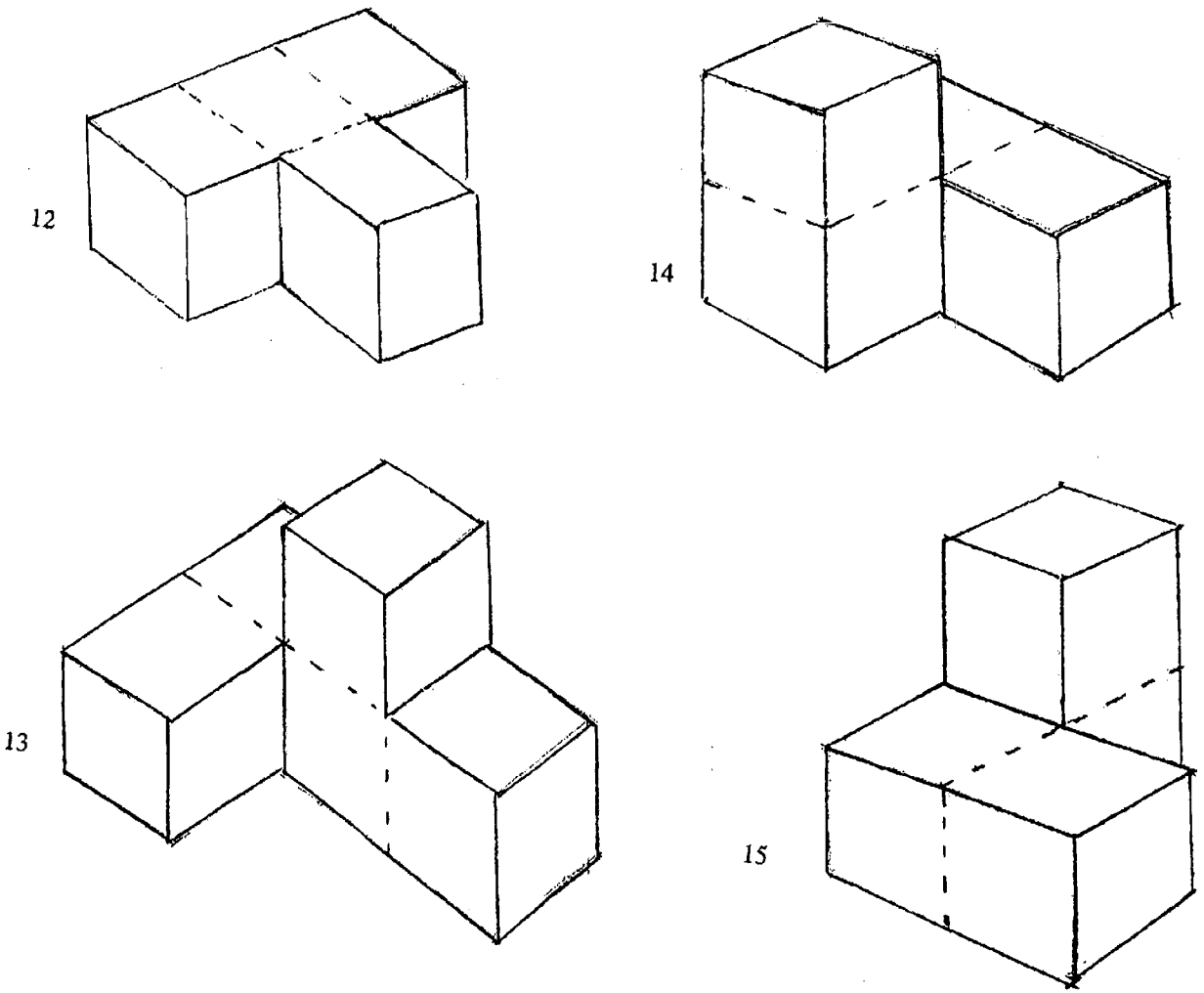
Figure 2:
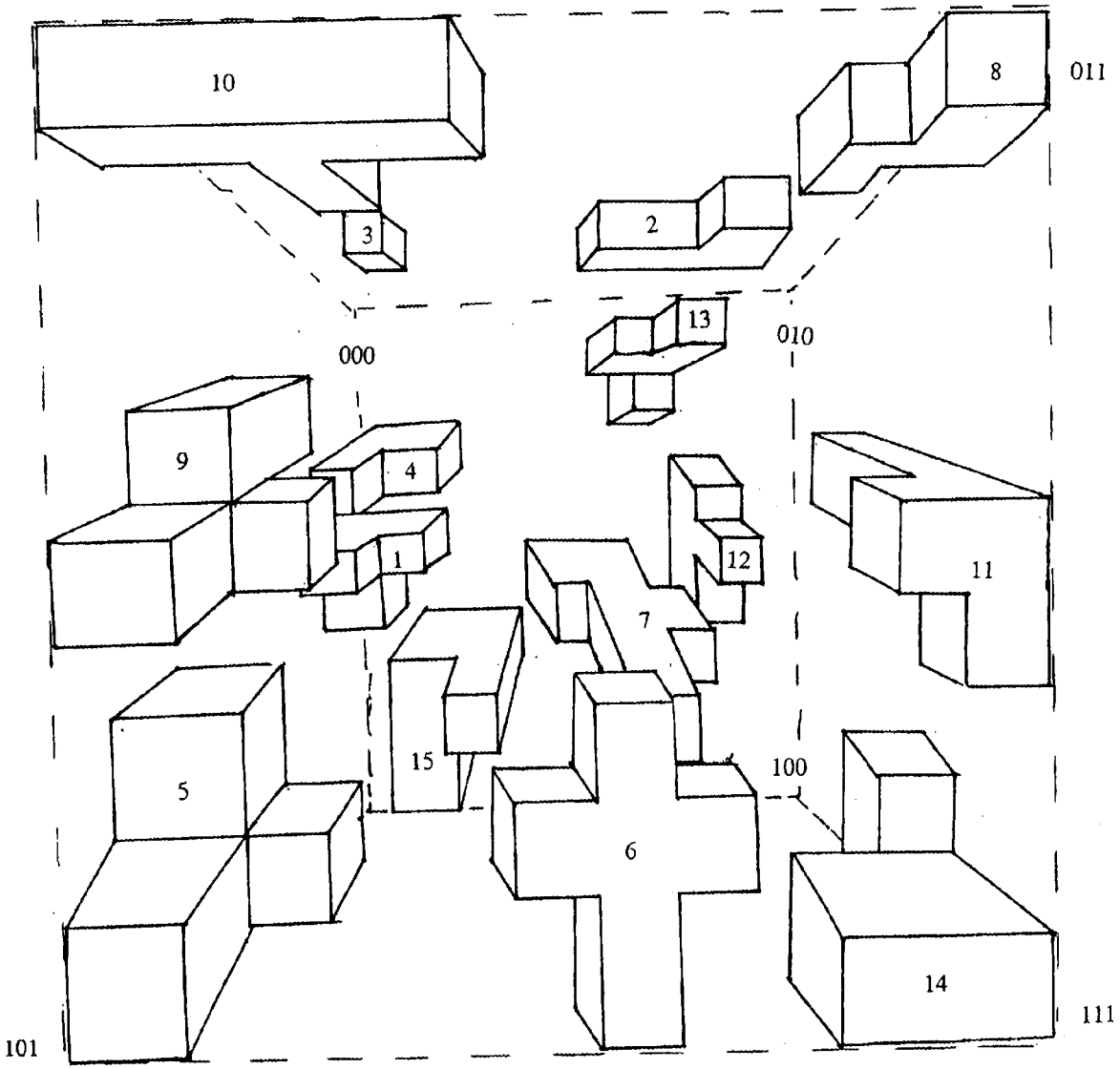
FIG. 2 is a presentation of one possible arrangement of the fifteen pieces to form a four by four by four cube.
Figure 2:
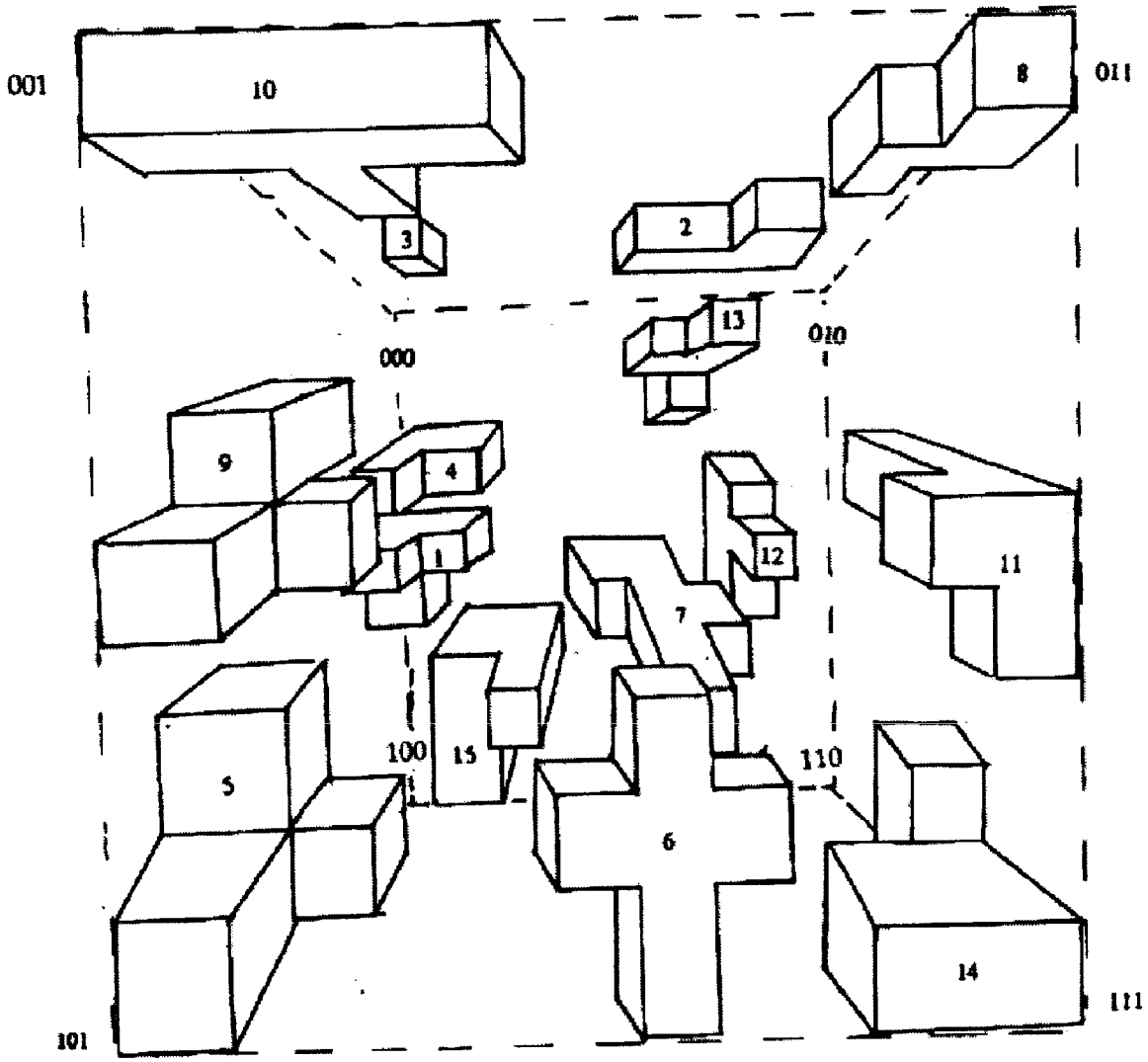

FIG. 2 illustrates in a perspective view, one way in which the fifteen individual pieces of the puzzle shown from FIG. 1 may be arranged to form a solid four by four by four cube. It will be appreciated by those skilled in the art that other configurations will also achieve a four by four by four cube.

In order to describe the location and orientation of the pieces within the puzzle, a gray scale coordinate system may be used. This gray scale coordinate system could be a simple zero to one having three places ranging from 000 to 111 as shown as encoded numbers at the corner of the matrix in FIG. 2. The first place in the gray scale coordinate would refer to the top or bottom vertex of the cube, the second digit signifies left or right vertex and the third digit signifies back or front vertex. The gray scale coordinate system may also utilize a numbering system which indicates each of the individual small cubes making up the larger four by four by four cube. Thus, a numbering system would utilize the digits 0 to 4 to indicate the vertices of each of the individual smaller cubes making up the larger four by four by four cube. In this configuration the gray scale would go from 000 to 444 indicating the top left back corner to the bottom right front corner.

In one embodiment the puzzle of the present invention is formed of a physical structure of cubes interconnected to form the individual components. These blocks could be sixty four equally shaped wooden cubes, which are glued to one another to form the fifteen pieces of the puzzle as described above. Alternatively, the individual pieces of the puzzle may be formed of a suitable polymeric material, such as polyethylene or polypropylene through a suitable molding operation, such as injection mold or blow molding.

The puzzle of the present invention shown in FIGS. 1 and 2 may also be used as an educational aid for mathematical modeling and complex theory. It could also be used in occupational or physical therapy for improving manipulation and cognitive skills.

In a further embodiment of the present invention, the puzzle may be provided as a computer game in which a suitable kinematic software program is provided enabling the individual components to be displayed, manipulated and assembled in a three dimensional virtual image on a computer screen.

A further embodiment of the invention would be the use of the three dimensional puzzle as a security access or encoding device. There are several possible ways in which the puzzle of the present invention may be so used. For example, each of the fifteen pieces may be provided as an image on the screen along with a three dimensional cubic lattice having a four by four by four dimension. In order to gain access to this system, the user would have to place the fifteen components in their specific locations in a specific order. If the components are not placed in the proper location or in the proper order, then access would be denied. In this system, the access is not only component location sequence and order sequence dependent, the components must also be oriented in relation to each other to complete the cube.

A second possibility is to assign an electromagnetic value or set of values to each space in the four by four by four cubic lattice and then assign a similar or different set of values to the individual cubes making up each of the pieces requiring a one to one match in the proper order in order to access the system.

Yet another way of utilizing the puzzle as an access system, would be to designate one of the fifteen pieces as a key which must be oriented in a specific orientation somewhere within the four by four by four matrix. If the component piece is not oriented in the proper orientation or placed in the proper place within the matrix, then the user would not be granted access to the system.

As can be observed, with the fifteen pieces, there are a large number of possible orientations in the ordering of the pieces to make up the four by four by four cube. Even utilizing only a single piece as a key to unlock the access system still gives rise to a large number of possibilities, as the key could be any of fifteen pieces with any of six orientation placed in any of the locations in the four by four by four cube. This would give rise to in excess of one thousand possible combinations, thus making the system difficult to overcome. With the single piece key, it would be easy to give the person who needs to access the system, the proper key by merely specifying the component piece, its orientation and the location within the grid where the piece is to be placed.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A three dimensional puzzle comprising fifteen geometrically different components which can be interconnected to form a four by four by four cube, the four by four by four cube is subdivided into sixty four equally sized smaller cubes, each of the fifteen individual pieces comprises from one to six of such smaller cubes interconnected to one another to form a unique three dimensional shape, the fifteen pieces comprising one piece with one small cube, one piece with three small cubes having two small cubes adjoined to adjacent sides of a third base cube, six pieces with four small cubes, a first four cube piece piece having a first base cube having two other cubes joined to adjacent sides and a fourth cube joined to a top surface, a second four cube piece having three cubes connected in series and a fourth cube connected to the adjacent side of the first cube in the three cube series, a third four cube piece having two cubes joined side by side with a third cube extending forwardly from the side of the right hand of the joined cubes and the fourth cube extending rearwardly from the left hand at the joined cubes and in the same plane as the two joined cubes, a fourth four cube piece in the shape of a tee having three cubes joined in series and the fourth cube joined at the side of the middle cube in the series, and a fifth and sixth four cube pieces being mirror images of one another and each having two sets of two cubes joined in series with a two cube set interconnected perpendicular to one another at side surfaces of end cubes six pieces with five small cubes, a first five cube piece having a base cube with three cubes joined to adjacent sides, and the fifth cube being joined to the top surface of the base cube, a second five cube piece having three cubes joined to one another in series with a fourth cube joined to the side of the base cube and the fifth cube joined to the side of the middle cube in the series opposite the side in which the fourth cube lays, a third five piece cube having a four cube configuration similar to piece 8 with a fifth cube attached to the top surface of the right hand of the two joined cubes, a fourth five cube piece in the shape of a tee having three cubes across the top and two cubes joined to the side of the middle cube in the top, a fifth five cube piece having a base cube with an individual cube joined to one side surface and two cubes in series joined to a second adjacent side surface with a fifth cube joined to the top surface of the base cube, and a sixth five cube piece having a base of three cubes in series with a fourth cube joined to the left side of the end most of the cubes in the series, and the fifth cube joined to top the surface of the middle cube in the series and one piece with six small cubes having four cubes joined to each of the sides of the base cube and the sixth cube being joined to the top surface of the base cube.

2. A three dimensional puzzle according to claim 1 wherein the three dimensional puzzle is constructed of a plurality of small wooden cubes joined to one another to form the individual pieces.

3. A three dimensional puzzle according to claim 1 wherein the three dimensional puzzle is provided as an electronic game.

4. A three dimensional puzzle according to claim 1 wherein the three dimensional puzzle is provided as an electronic encryption system in association with a spatial coordinate reference system to be used as an encryption device for an electronic or computer security access code.

* * * * *

UNITED STATES PATENT AND TRADEMARK OFFICE

CERTIFICATE OF CORRECTION

PATENT NO. : 6,648,330 B2
APPLICATION NO. : 10/071093
DATED : November 18, 2003
INVENTOR(S) : Michael Porter It is certified that error appears in the above-identified patent and that said Letters Patent is hereby corrected as shown below:

The title page should be deleted and substitute therefore the attached title page as shown on the attached page.

Signed and Sealed this

Twenty-second Day of August, 2006

JON W. DUDAS
*Director of the United States Patent and Trademark Office*

(12) United States Patent
Porter

(10) Patent No.: US 6,648,330 B2
(45) Date of Patent: Nov. 18, 2003

(54) THREE DIMENSIONAL PUZZLE

(76) Inventor: Michael Porter, 360 A Bloor St. W #19002, Toronto, Ont. (CA), M5S 1X1

( * ) Notice: Subject to any disclaimer, the term of this patent is extended or adjusted under 35 U.S.C. 154(b) by 0 days.

(21) Appl. No.: 10/071,093

(22) Filed: Feb. 11, 2002

(65) Prior Publication Data

US 2003/0151195 A1 Aug. 14, 2003

(51) Int. Cl.[7] ..... A63F 9/12
(52) U.S. Cl. ..... 273/153 R; 273/156
(58) Field of Search ..... 273/153 R, 156, 273/157; 434/403, 406, 433

(56) References Cited

U.S. PATENT DOCUMENTS 332,256 A * 12/1885 Keeler ..... 273/160
3,788,645 A * 1/1974 Nelson ..... 273/156
4,153,254 A 5/1979 Mare
4,534,563 A * 8/1985 Guenther ..... 273/157 R
4,662,638 A 5/1987 Vachek
4,699,602 A 10/1987 Giorgi
4,784,392 A 11/1988 Johnson et al.
4,844,466 A * 7/1989 Johnson et al. ..... 273/157 R
5,393,063 A 2/1995 Iohimaru
5,405,135 A 4/1995 Embro
5,868,388 A * 2/1999 Wood et al. ..... 273/157 R
6,095,521 A 8/2000 Patel

* cited by examiner

*Primary Examiner*—Kien T. Nguyen

(57) ABSTRACT

The present invention provides for a new three dimensional puzzle apparatus having fifteen geometrically different components which can be interconnected to form a four by four by four cube. The four by four by four cube is subdivided into sixty four equally sized smaller cubes. Each of the fifteen individual pieces have from one to six of such smaller cubes interconnected to one another to form a unique three dimensional shape. The fifteen pieces include one piece with one small cube, one piece with three small cubes, six pieces with four small cubes, six pieces with five small cubes and one piece with six small cubes. The three dimensional puzzle can be used as a toy or game as well as for educational and security purposes.

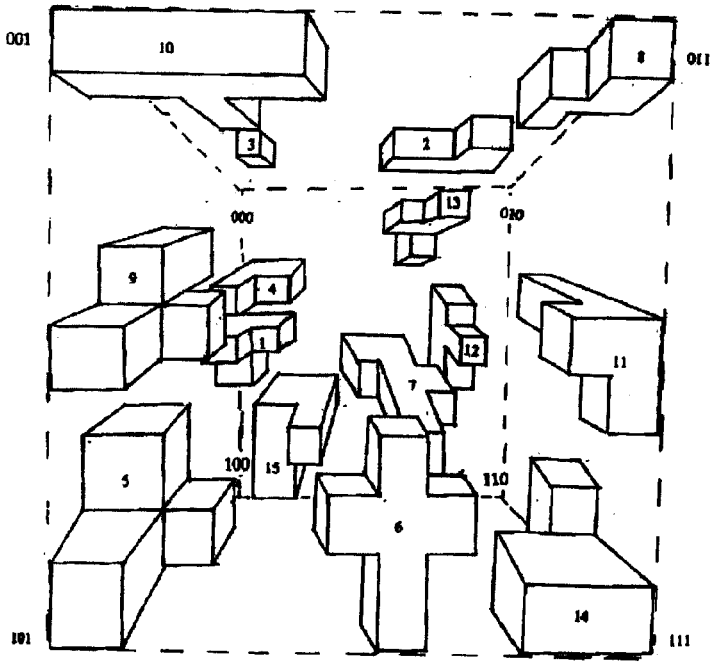

4 Claims, 3 Drawing Sheets